US007243442B2

(12) United States Patent
Myerholtz et al.

(10) Patent No.: US 7,243,442 B2
(45) Date of Patent: Jul. 17, 2007

(54) APPARATUS FOR DRYING GROUND

(75) Inventors: Robert Myerholtz, Weston, OH (US); Claude Bourgault, St. Brieux (CA); Larry Dancey, St. Brieux (CA); Neil Eisner, St. Brieux (CA); Glenn Hantke, St. Brieux (CA)

(73) Assignee: Bourgault Industries Ltd., Saskatchewan (CA)

( * ) Notice: Subject to any disclaimer, the term of this patent is extended or adjusted under 35 U.S.C. 154(b) by 0 days.

(21) Appl. No.: 11/212,453

(22) Filed: Aug. 26, 2005

(65) Prior Publication Data

US 2006/0254072 A1 Nov. 16, 2006

(30) Foreign Application Priority Data

May 16, 2005 (CA) ..... 2507402

(51) Int. Cl.
*F26B 25/00* (2006.01)

(52) U.S. Cl. ..... 34/103; 34/104; 34/201; 34/611

(58) Field of Classification Search ..... 34/103, 34/104, 201, 611
See application file for complete search history.

(56) References Cited

U.S. PATENT DOCUMENTS 3,324,846 A * 6/1967 Smith ..... 126/271.1
3,495,932 A * 2/1970 Tuma ..... 422/34
3,668,817 A * 6/1972 Bell ..... 53/397
4,571,849 A * 2/1986 Gardner et al. ..... 34/79
5,590,478 A * 1/1997 Furness ..... 34/437
5,881,476 A * 3/1999 Strobush et al. ..... 34/451
5,910,598 A * 6/1999 Shofner et al. ..... 55/385.2
5,960,564 A * 10/1999 McElroy et al. ..... 34/666
5,992,051 A * 11/1999 Salehibakhsh ..... 34/638
2005/0028399 A1* 2/2005 Merschat ..... 34/92

FOREIGN PATENT DOCUMENTS

EP 1 659 062 * 5/2006

* cited by examiner

*Primary Examiner*—S. Gravini
(74) *Attorney, Agent, or Firm*—Frost Brown Todd LLC

(57) ABSTRACT

A method for drying a surface comprises supporting a fabric cover above the surface, and holding side edges of the fabric cover against the surface such that an air channel is formed between the fabric cover and the surface. The air channel has an inlet end and a discharge end, and a pressurized warm air stream having a relative humidity less than an ambient relative humidity is directed into the inlet end of the air channel such that the warm air stream moves through the air channel to the discharge end and out to the atmosphere. An apparatus for practicing the invention provides a plenum along the inlet end with plenum outlets to discharge the warm air stream, and cover supports extending out from the plenum to support the cover above the surface. A fabric tube plenum and cover supports provide versatility and portability.

15 Claims, 3 Drawing Sheets

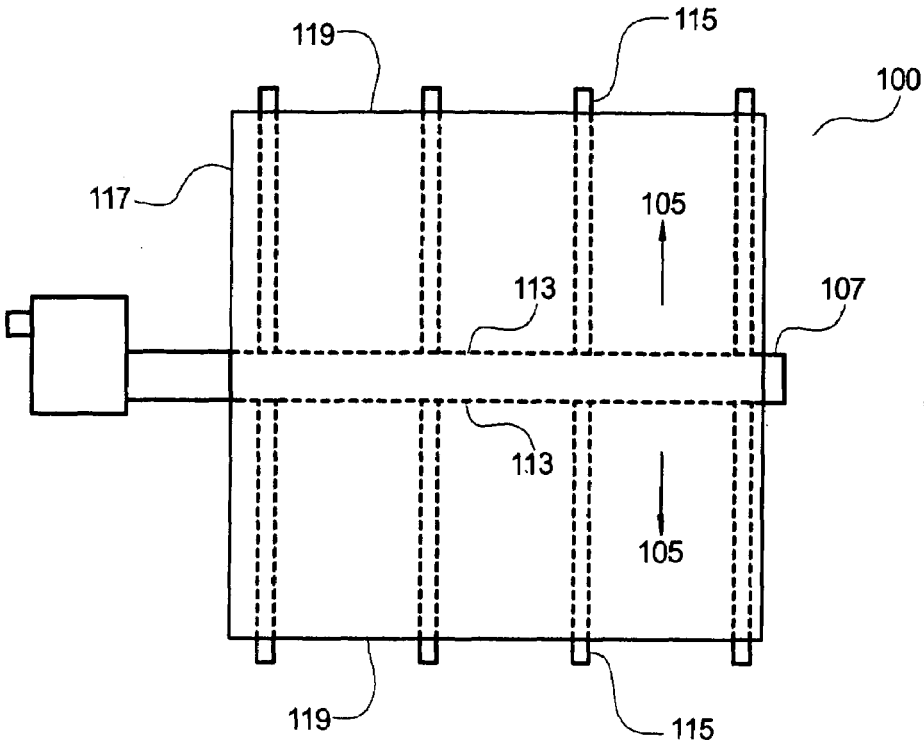
Fig. 4
Fig. 5
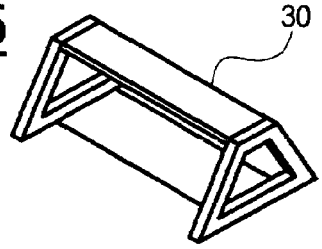
Fig. 6
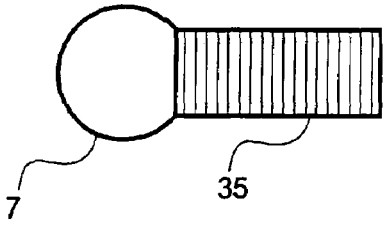
Fig. 7
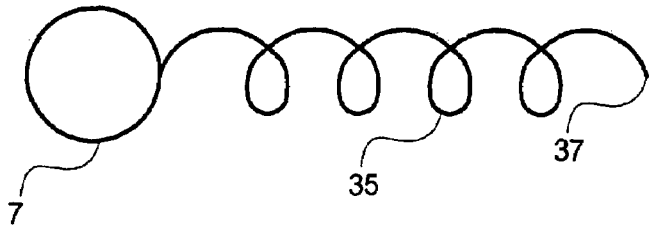

APPARATUS FOR DRYING GROUND

This invention is in the field of drying equipment and methods, and in particular drying large surfaces of ground or the like.

BACKGROUND OF THE INVENTION

Wet ground conditions on a construction site or in a building shell can delay progress on the project. Conventionally, it is required to wait for weather conditions to change, and for natural drying conditions to occur. Where economically feasible, it is also sometimes known to remove wet soil and replace it with drier material if such is available within a reasonable distance. Such removal is often not possible if soil is very wet.

Wet soil conditions are of course more common in geographic areas with high rainfall, and in such areas considerable down-time is experienced. Often just as the ground is drying to a suitable level, more rain will fall wetting the soil again.

The problem of flooded or wet buildings has been addressed in the prior art. U.S. Pat. No. 6,457,258 to Cressy et al. discloses an apparatus for drying flooded buildings by introducing very hot and dry air into the building, indicated as being at 125° F. and 5% relative humidity, in order to dry the building very quickly to prevent mold growth and allow an early return to occupants. In the apparatus of Cressy et al., outside air is heated by a furnace and the heated air is blown into the building where it picks up moisture and then is exhausted back outside.

U.S. Pat. No. 6,647,639 to Storrer, "Moisture Removal System", addresses the problem of extracting water promptly to prevent the formation of rot, mold, rust and the like in flooded buildings. Storrer reveals the prior art as including passive drying through opening windows, etc. and active drying using forced air (heated or not) to expedite evaporation.

SUMMARY OF THE INVENTION

It is an object of the present invention to provide a method and apparatus for drying large surfaces of ground or the like that overcomes problems in the prior art.

The present invention provides, in a first embodiment, an apparatus for drying a surface. The apparatus comprises an elongated plenum having an inlet adapted for operative connection to a heater outlet to receive a pressurized warm air stream, and a plurality of plenum outlets spaced along a length of at least one side of the plenum. A plurality of cover supports extend laterally from the at least one side of the plenum, and a fabric cover extends from the plenum above the plenum outlets and laterally over the cover supports to a distal cover end thereof removed from the plenum and supported above the surface. Means are provided operative to hold the fabric cover substantially against the surface at side edges thereof such that the cover forms an air channel such that when the warm air stream enters the air channel through the plenum outlets, the warm air stream moves over the surface under the fabric cover to the distal cover end and is discharged into the atmosphere. The apparatus is configured such that the fabric cover can be located above a surface to be dried.

The present invention provides, in a second embodiment, an apparatus for drying a surface. The apparatus comprises a heater operative to discharge a pressurized warm air stream having a relative humidity less than an ambient relative humidity through a heater outlet. A fabric plenum tube has an inlet operatively connected to the heater outlet to receive the warm air stream, and a plurality of plenum outlets are spaced along a length of at least one side of the plenum tube. The plenum outlets are configured such that flow of the warm air stream through the plenum outlets is restricted and pressure exerted by the warm air stream inflates the plenum tube. A plurality of fabric support tubes extend laterally from the at least one side of the plenum, and are operatively connected to the plenum tube such that pressure exerted by the warm air stream inflates the fabric support tubes. A fabric cover extends from the plenum tube above the plenum outlets and laterally over the support tubes to a distal cover end thereof removed from the plenum tube and supported above the surface. Means are provided operative to hold the fabric cover substantially against the surface at side edges thereof such that the cover forms an air channel such that when the warm air stream enters the air channel through the plenum outlets, the warm air stream moves over the surface under the fabric cover to the distal cover end and is discharged into the atmosphere. The apparatus is configured such that the fabric cover can be located above a surface to be dried.

The present invention provides, in a third embodiment, a method of drying a surface comprising supporting a fabric cover above the surface, and holding side edges of the fabric cover against the surface such that an air channel is formed between the fabric cover and the surface. The air channel has an inlet end and a discharge end, and a pressurized warm air stream having a relative humidity less than an ambient relative humidity is directed into the inlet end of the air channel such that the warm air stream moves through the air channel to the discharge end and out to the atmosphere.

The warm air stream has a relative humidity less than that of the ambient air and the moving dry air maintains a substantial moisture gradient between the air in the air channel and the wet surface such that moisture is absorbed by the air in the warm air stream at an increased rate relative to natural drying. When the warm air stream moves over the surface under the fabric cover to the distal cover end it absorbs moisture from the surface and the moisture is discharged into the atmosphere with the air stream. Considerable versatility is provided by providing fabric tubes for the plenum and cover supports that are inflated by the warm air stream, and can be maneuvered to fit irregular surface contours and dimensions, and can be folded or rolled for transport.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

FIG. 4 is schematic top view of an alternate embodiment where the cover extends out from both sides of the plenum;

FIG. 5 is a perspective view of an alternate embodiment of the cover support;

FIG. 6 is a side view of a further alternative embodiment of the cover support in a retracted position;

FIG. 7 is a side view of the embodiment of FIG. 6 in an extended position;

DETAILED DESCRIPTION OF THE ILLUSTRATED EMBODIMENTS

Figure 1:
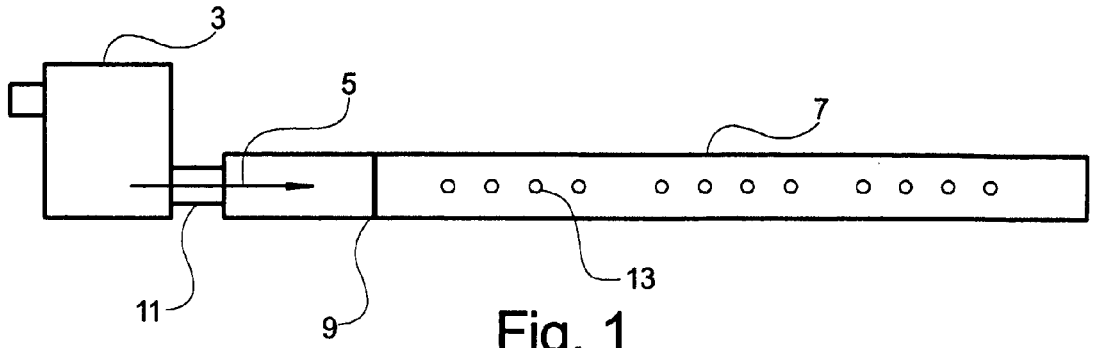
FIG. 1 is a front view of the heater and plenum of an embodiment of the invention.
Figure 2:
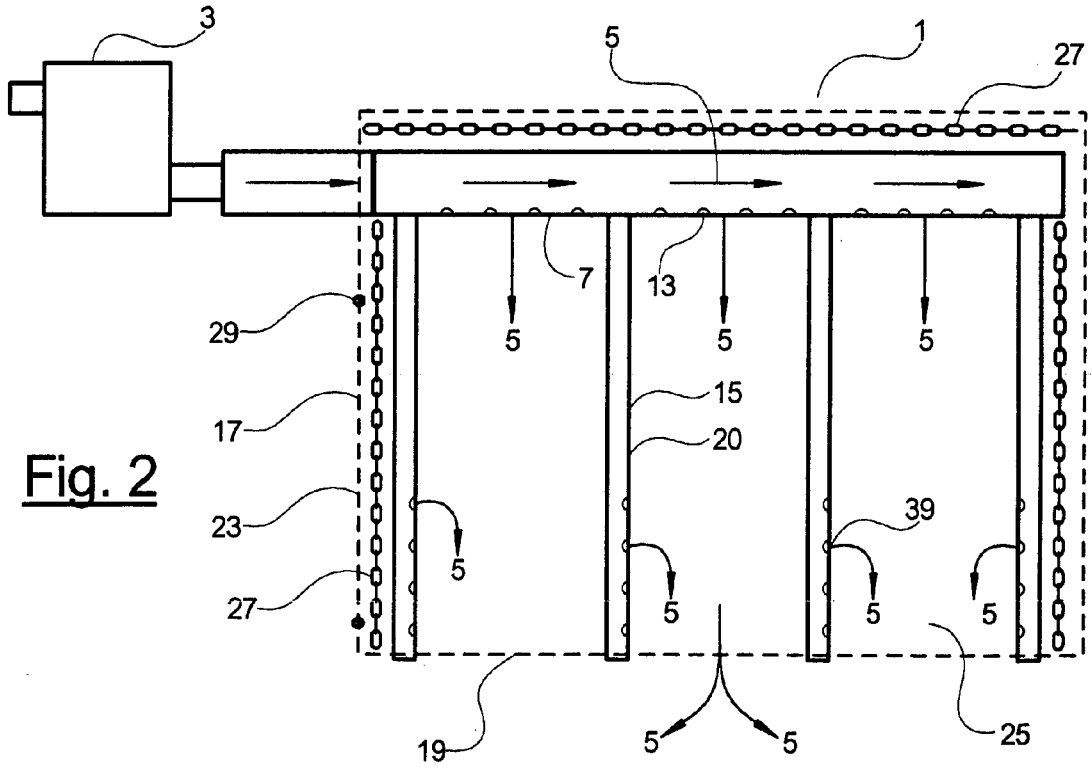
FIG. 2 is a top view of the embodiment of the invention using the heater and plenum of FIG. 1 with the cover illustrated in phantom lines for clarity of illustration.
Figure 3:
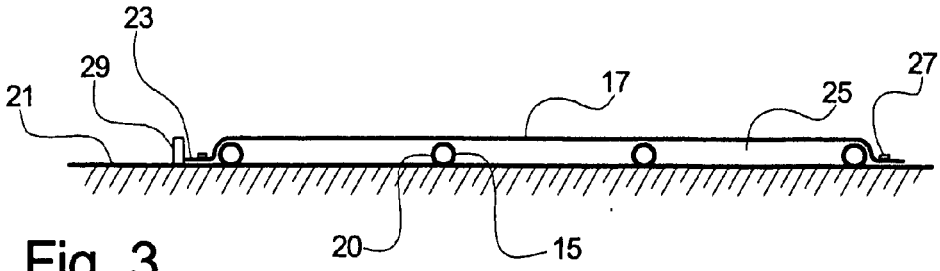
FIG. 3 is a schematic front view showing the discharge end of the embodiment of FIG. 2.

FIGS. 1–3 schematically illustrate an apparatus 1 for drying a surface 21. The apparatus 1 comprises a heater 3 that creates a pressurized warm air stream 5 having a temperature above that of the ambient air, and a relative humidity less than the ambient relative humidity. Heating air raises the temperature and reduces the relative humidity of heated air discharged by the heater 3 relative to cooler ambient air entering the heater. The heater 3 will be a portable heater, furnace or the like with a fan to provide a pressurized warm air stream 5. For best results the heater 3 will be of a type that heats the air stream 5 without adding combustion gases to the air stream. Such combustion gases can include water vapor, and so reduce the drying effect of the warm air stream 5 by increasing the relative humidity thereof.

An elongated plenum 7 has an inlet 9 operatively connected to the heater outlet 11. A plurality of plenum outlets 13 are spaced along a length of the plenum 7. A plurality of cover supports 15 extend laterally from the plenum 7 on the same side of the plenum as the plenum outlets are located. A fabric cover 17, shown in phantom lines in FIG. 2 for clarity of illustration, extends from the plenum 7 above the plenum outlets 13 and laterally over the cover supports 15 to a distal cover end 19 thereof removed from the plenum 7 and supported above the surface 21.

The fabric cover 17 is held substantially against the surface 21 at side edges 23 thereof. Weights can be placed along the side edges 23 on top of the cover 17, and conveniently a chain 27 is illustrated as providing such weights. The chain 27 can be adjusted in length as required, and is conveniently portable, compared to individual weights which would require a container to carry them from location to location. Where wind could cause the cover 17 to lift, it may also be required to use fasteners, such as stakes 29, to fasten the cover to the surface 21, such as to a ground surface.

The cover 17 is thus supported above the surface 21 by the cover supports 15, and sealed such that the cover 17 forms an air channel 25. In the illustrated embodiment, economically and conveniently the cover 17 is draped over the top of the plenum 7 and held against the surface 21 by a chain 27 in the same manner as the side edges 23 are held. The plenum outlets 13 are thus located under the cover 17. When the warm air stream 5 enters the air channel 25 through the plenum outlets 13, the warm air stream 5 moves over the surface 21 under the fabric cover 17 to the distal cover end 19 and is discharged into the atmosphere. The warm air stream 5 has a relative humidity less than that of the ambient air and the moving dry air maintains a substantial moisture gradient between the air in the air channel 25 and the wet surface 21 such that moisture is absorbed by the air in the warm air stream 5 at an increased rate relative to natural drying.

The apparatus is configured by varying the lengths of the plenum 7 and cover supports 15, and the corresponding size of the cover 17 such that the fabric cover 17 can be located above a surface that is desired to be dried.

The plenum 7 conveniently is provided by a fabric plenum tube, and the plenum outlets 13 are configured such that flow of the warm air stream 5 through the plenum outlets 13 is restricted somewhat so that pressure exerted by the warm air stream 5 inflates the fabric plenum tube. Similarly the cover supports 15 can be conveniently provided by fabric support tubes 20 operatively connected to the plenum 7 such that pressure exerted by the warm air stream 5 inflates the fabric support tubes. The fabric support tubes 20 can be connected to corresponding holes in the plenum 7 such that the air stream 5 exerts pressure to inflate the support tubes 20 as well as the plenum tube, or could be similarly connected to a rigid plenum 7. The fabric support tubes can be connected by zippers, hook and loop fasteners, welding, sewing, or the like.

While the plenum 7 could be provided by a substantially rigid tube, the fabric plenum and support tubes provide considerable advantages in versatility and in portability. The term "fabric" is used herein to refer to any flexible sheet material made from solid or woven plastic, impregnated cloth, and like materials as are known in the art for providing a flexible, foldable sheet that can be worked into hollow tubes by various means. Thus the fabric cover and fabric tubes are light weight and can be readily folded or rolled into relatively compact bundles for transport. Such fabric tubes also can be tied off to shorten them to accommodate shorter lengths where the surface area dictates. They can also be bent readily to follow irregular surface areas, and will flex to follow irregular surface topography, such as is common when drying ground surfaces. Similarly the fabric cover can be folded over to follow irregularities in side edges, or where a smaller cover is desired.

Alternatively the cover supports 15 could comprise substantially rigid frames configured to rest upright on the surface. Such a frame 30 is schematically illustrated in FIG. 5. Alternatively again FIGS. 6 and 7 illustrate an extendable support member in the form of a coil 35 having a distal support end 37 remote from the plenum 7. The coil 35 is operative to extend and retract such that a distance from the plenum 7 to the distal support end 37 can be varied to accommodate varying desired surface areas. Telescoping members could be suitable as well.

The cover supports 30 and 35 of FIGS. 5–7 will allow the air stream to flow through the cover supports, while the fabric support tubes 20 substantially follow the ground on their bottoms and the fabric cover on their tops, and so air is substantially prevented from passing through such fabric tube cover supports. This might be desirable in ensuring that there is a more even air flow across the width of the surface. Since the fabric support tubes 20 form an air block between the cover 17 and the surface 21, air entering the air channel 25 between a pair of cover supports 15 is substantially maintained between that pair of cover supports 15 until discharged into the atmosphere. Where the surface is uneven, some areas of the air channel 25 may provide more resistance to air flow than others, with the result that they receive less air flow and thus less drying. By ensuring the air is maintained between the support tubes 20 this effect can be at least somewhat reduced.

The fabric support tubes 20 provide a further alternative to facilitate even drying of the surface 21. As the air stream 5 moves from the plenum 7 toward the distal cover end 19 it picks up moisture and loses heat, and the relative humidity thereof rises. Where the area to be dried and thus the cover 17 and support tubes 20, are lengthy, by the time the air stream 5 reaches the farther portions of the air channel 25 the drying effect will be reduced. If desired, support tube outlets 39 can be provided in distal portions of the fabric support tubes 20, such that dry air from the plenum 7 is directed into the air channel 25 at locations nearer the discharge to the atmosphere to promote drying of the areas farther from the plenum 7, as illustrated in FIG. 2.

Figure 8:
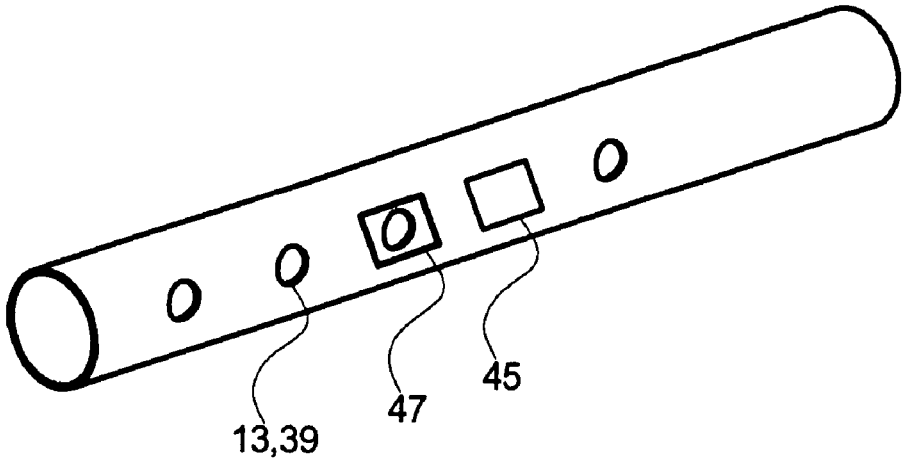
FIG. 8 is a perspective view of fabric covers for selectively opening and closing plenum outlets and support tube outlets.

Sensors could be provided to detect the surface moisture level at various locations along the length of the support tubes 20, and then the operator could close or open appropriate plenum outlets 13 and support tube outlets 39 in combination to achieve a greater drying effect where required. As illustrated in FIG. 8, covers such as fabric patches 45 could be attachable with hook and loop fasteners 47 or the like to selectively cover or uncover the plenum outlets 13 and support tube outlets 39.

The fabric tubes and cover are also quite light and easy to handle. When drying ground for example, it may be desirable to effect an initial drying of the surface, and then move the apparatus off the surface, cultivate or otherwise stir up the ground to expose wetter soil beneath the surface, and then put the apparatus back in place. This is relatively easy to accomplish with the fabric cover and tube apparatus.

FIG. 4 schematically illustrates an alternate embodiment 100 for drying lengthy surface areas. Cover supports 115 extend laterally from opposite sides of the plenum 107, and plenum outlets 113 are provided along corresponding opposite sides of the plenum 107. The fabric cover 117 extends over the plenum 107 and cover supports 115 to distal cover ends 119 on opposite sides of the plenum 107. Thus the air stream 105 moves both directions from the plenum 107, and thus the relative humidity does not rise excessively prior to discharge to the atmosphere.

The present apparatus also prevents rain, snow and the like from re-wetting the surface. Cover supports 15 in the middle portion can be made somewhat higher to provide a slope toward the side edges 23 of the cover, or a slope can be provided from a higher plenum to a lower distal end. During rain the heater 3 can remain operating to maintain pressure under the cover 17 and maintain a taut cover to facilitate shedding rain. Added pressure and tautness for better shedding rain can be provided if desired by partially blocking the flow of air out of the distal end of the cover. Further, operating the heater 3 can cause snow falling on the cover 17 to melt and run off.

Sensors and controls can be provided to monitor and control operating parameters. Time, ground moisture content, air flow, ambient and heated air temperature, relative humidity, etc. will affect the progress of the drying operation. The controls can be configured to start, stop or regulate the system in accordance with a preset program or measured parameters. It is contemplated that the rate of drying could be determined for soils of certain types and moisture levels at varying temperatures, velocities, and relative humidities of the air stream such that an optimum or desired drying time, energy efficiency, and the like could be achieved. The temperature, velocity, and relative humidity of the air stream could then be controlled in accordance with the desired end.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. An apparatus for drying a surface, the apparatus comprising:

an elongated plenum having an inlet adapted for operative connection to a heater outlet to receive a pressurized warm air stream, and a plurality of plenum outlets spaced along a length of at least one side of the plenum;

a plurality of cover supports extending laterally from the at least one side of the plenum; and a fabric cover extending from the plenum above the plenum outlets and laterally over the cover supports to a distal cover end thereof removed from the plenum and supported above the surface;

means operative to hold the fabric cover substantially against the surface at side edges thereof such that the cover forms an air channel such that when the warm air stream enters the air channel through the plenum outlets, the warm air stream moves over the surface under the fabric cover to the distal cover end and is discharged into the atmosphere;

wherein the apparatus is configured such that the fabric cover can be located above a surface to be dried.

2. The apparatus of claim 1 wherein the plenum comprises a fabric plenum tube and wherein the plenum outlets are configured such that flow of the warm air stream through the plenum outlets is restricted and pressure exerted by the warm air stream inflates the fabric plenum tube.

3. The apparatus of claim 1 wherein the plenum comprises a substantially rigid tube.

4. The apparatus of claim 1 wherein at least one cover support comprises a fabric support tube operatively connected to the plenum such that pressure exerted by the warm air stream inflates the at least one fabric support tube.

5. The apparatus of claim 4 further comprising a plurality of support tube outlets spaced along a portion of the fabric support tube.

6. The apparatus of claim 5 further comprising a cover releasably attachable to close at least one support tube outlet.

7. The apparatus of claim 1 wherein at least one cover support comprises an extendable support member having a distal support end remote from the plenum and operative to extend and retract such that a distance from the plenum to the distal support end can be varied.

8. The apparatus of claim 7 wherein the extendable support member comprises a coil.

9. The apparatus of claim 1 wherein at least one cover support comprises a substantially rigid frame configured to rest upright on the surface.

10. The apparatus of claim 1 comprising cover supports extending laterally from opposite sides of the plenum, and comprising plenum outlets along corresponding opposite sides of the plenum, and wherein the fabric cover extends over the plenum and cover supports to distal cover ends on opposite sides of the plenum.

11. The apparatus of claim 1 wherein the side edges of the fabric cover are held against the surface at least partly by weights.

12. The apparatus of claim 11 wherein at least one weight is provided by a length of chain.

13. The apparatus of claim 1 wherein the side edges of the fabric cover are held against the surface at least partly by fasteners connected to the fabric cover and the surface.

14. The apparatus of claim 13 wherein at least one fastener comprises a stake driven into the surface.

15. The apparatus of claim 1 further comprising a cover releasably attachable to close at least one plenum outlet.

* * * * *